United States Patent [19]

Lancaster

[11] Patent Number: 4,470,430

[45] Date of Patent: Sep. 11, 1984

[54] DRILLING CHOKE

[76] Inventor: Robert D. Lancaster, 4902 Mayfair, Bellaire, Tex. 77401

[21] Appl. No.: 266,706

[22] Filed: May 26, 1981

[51] Int. Cl.[3] ..... F16K 43/00

[52] U.S. Cl. ..... 137/315; 137/556; 166/91; 166/97; 166/320; 175/38; 175/218; 251/214; 251/291; 251/360

[58] Field of Search ..... 137/315, 454.2, 454.5, 137/556; 166/91, 97, 320; 175/38, 218; 251/360, 291, 214

[56] References Cited

U.S. PATENT DOCUMENTS

| | | | |
|---|---|---|---|
| 990,111 | 4/1911 | Coon et al. | 137/315 |
| 4,257,442 | 3/1981 | Claycomb | 137/238 |
| 4,281,678 | 8/1981 | Claycomb | 137/315 |
| 4,342,363 | 8/1982 | Reed | 166/97 |

FOREIGN PATENT DOCUMENTS

| | | | |
|---|---|---|---|
| 428171 | 8/1911 | France | 137/556 |
| 526297 | 5/1955 | Italy | 137/556 |

*Primary Examiner*—George L. Walton
*Attorney, Agent, or Firm*—Bill B. Berryhill

[57] ABSTRACT

A drilling choke for controlling flow of drilling fluids from a well comprising: a body having an inlet and outlet and an intermediate cavity therebetween; a seat member coaxially disposed in the body outlet; an operator assembly removably attached to the body; and a stem assembly connected to the operator assembly for axial movement thereof. A portion of the stem assembly is removable, upon removal of the operator assembly from the body, without otherwise disturbing the operator assembly.

20 Claims, 3 Drawing Figures fig.1
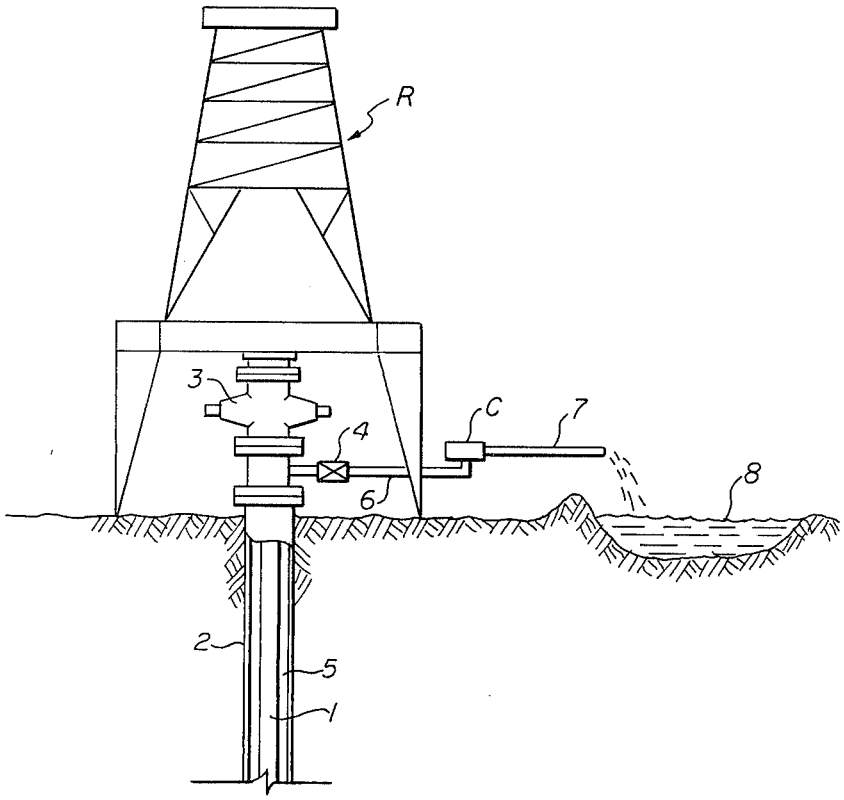
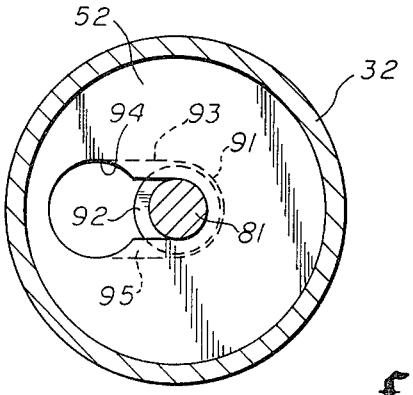
fig.3

DRILLING CHOKE

BACKGROUND OF THE INVENTION

1. Field of the Invention

The present invention pertains to apparatus for controlling flow of fluids from an oil and/or gas well. In particular, it pertains to apparatus commonly referred to as "chokes" for controlling the flow of fluids from an oil and/or gas well. More specifically, the present invention pertains to drilling chokes for controlling the flow of fluids from a well as such well is being drilled.

2. Background of the Invention

During the drilling of an oil and/or gas well, the drill string may penetrate into a high pressure gas pocket which when encountered seeks relief through the drill string and surrounding hole to the surface of the earth. If the pressure and/or volume of gas is sufficient, drilling fluids are carried to the surface with the gas and could cause potential loss of control of the well. In fact, the drill string may be blown out of the well and portions of the drilling unit destroyed. Of course, such occurrence may also result in death or serious injury to drilling personnel.

To prevent such loss of well control, various control apparatus are provided. Blowout preventers may be provided for closing the annulus around the drill string. Another control device is the drilling choke. There are a number of types of drilling chokes, but basically these chokes usually include a body having an inlet and an outlet, the outlet of which is provided with a seat assembly. Also included is a stem assembly on the end of which is a tip capable of sealing engagement with the seat assembly. An operator assembly, usually hydraulically or pneumatically operated, moves the stem assembly to various positions, causing the flow of fluids from the well to be regulated by the variable flow passage created by the seat assembly and the stem.

The amount of flow allowed through the drilling choke may be automatically or manually controlled based on the fluid pressures and volumes encountered during drilling. Drill pipe pressure, choke manifold pressure, choke position and various other information is usually indicated at a position on the drilling rig to enable the operator to control the well.

Drilling chokes are manufactured by a number of companies including Cameron Iron Works, Inc.; Thornhill-Craver Co., Inc.; N.L. Industries, Inc., all of Houston, Tex., and others. Due to the high pressures, high volumes and abrasive characteristics of drilling fluids, some of the internal components of a drilling choke, particularly the seat and stem assemblies, require frequent repair or replacement. To replace or repair the seat assembly or the stem assembly of a drilling choke, it is normally necessary to first remove the operator assembly from the choke body. Then the seat assembly and stem assembly can be reached for such repair or replacement. To remove the stem assembly, it is normally necessary to disturb the pneumatic or hydraulic portions of the operator assembly causing the loss of the operator assembly fluids. This is time-consuming, messy and costly, among other things.

Furthermore, most drilling chokes are provided with some type of position indicator which is attached to the operator assembly. In fact, most drilling chokes are provided with a position rod which is coaxially aligned with the stem assembly, but projects in the opposite direction from the operator assembly. This results in undue length, bulkiness and complexity of the choke. For example, due to the fact that the position rod projects out of the operator assembly, usually from a piston carried therein, additional seals and sealing surfaces are required. This is more expensive and more susceptible to leaking.

SUMMARY OF THE PRESENT INVENTION

In the present invention a new and improved drilling choke is provided for controlling flow of fluids from a well. The choke comprises: a body having an inlet and outlet and an intermediate cavity therebetween; a seat assembly coaxially disposed in the body outlet; an operator assembly removably attached to the body; and a stem assembly connected to the operator assembly for axial movement thereof.

The stem assembly includes an upper stem member and a lower stem member and a tip member. The lower stem member and tip member are removable, upon removal of the operator assembly from the body, without otherwise disturbing the operator assembly. Thus, the portion of the stem assembly exposed to fluid flow is removable in the field without disturbing the hydraulics and/or pneumatics of the operator assembly. Other components of the choke, such as the seat assembly, may be easily removed for repair or replacement in the field, upon removal of the operator assembly.

With the drilling choke of the present invention, a position indicator is installed in such a way as to eliminate the necessity of a double rod or stem arrangement within the operator assembly. The position indicator is attached directly to the stem assembly eliminating the need for a position rod, shortening the overall length of the choke and making it unnecessary to disturb the position indicator or the operator hydraulics upon replacement of the exposed portions of the stem assembly. In addition, the arrangement of the position indicator and its connection to the stem assembly provides visual indication of the position of the choke at the choke itself, in addition to the position indication at the operator's station.

The construction of the drilling choke of the present invention is relatively simple and inexpensive when compared with drilling chokes of the prior art. Its unique construction and arrangement allows easy replacement and repair of wear susceptible parts and results in less wear on components that are not easily replaced. These and many other objects and advantages of the invention will be apparent from the description which follows in conjunction with the accompanying drawings.

BRIEF DESCRIPTION OF THE DRAWINGS

FIG. 1 is a schematic representation of a drilling rig drilling an oil and/or gas well and utilizing a drilling choke, according to a preferred embodiment of the invention;

FIG. 3 is a cross sectional view of the drilling choke of FIG. 2 taken along line 3—3 thereof.

DESCRIPTION OF THE PREFERRED EMBODIMENT

Figure 2:
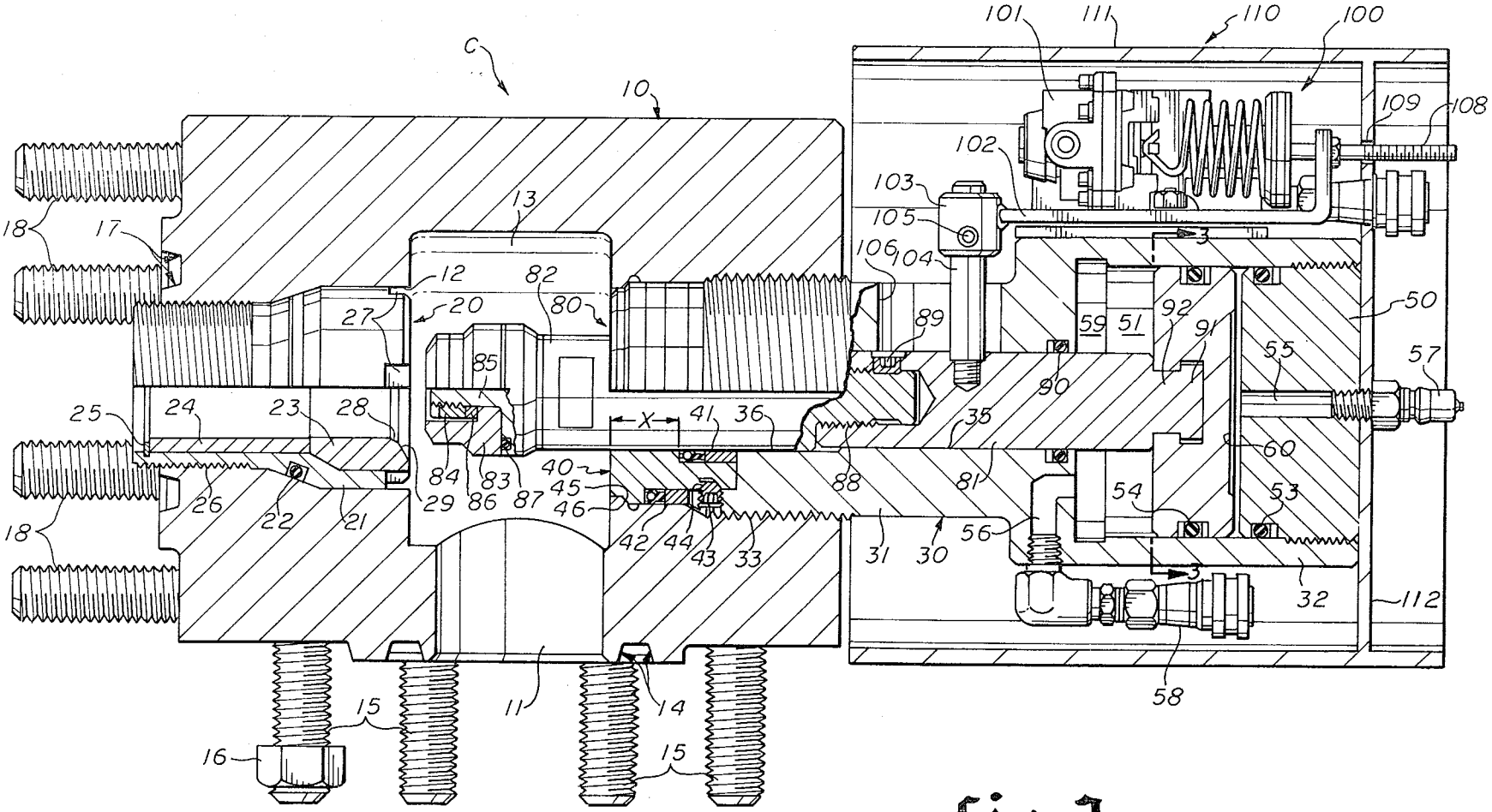
FIG. 2 is a longitudinal view of a drilling choke, partially in section, according to a preferred embodiment of the invention.

Referring first to FIG. 1, there is shown a drilling rig R drilling an oil and/or gas well by rotation of a drill string 1. The drill string 1 is surrounded by a surface casing 2 surmounted on which is a blowout preventer stack 3 or other similar flow controls. Below the blowout preventer stack 3 is a valve 4 through which flow communication may be established with the annulus 5 between the drill string 1 and casing 2. A flow line 6 connects the valve 4 to the inlet of a drilling choke C. The outlet of the drilling choke C is connected to a pipe 7 which discharges into a mud pit 8. Thus, fluids carried to the surface through the annulus 5 may be displaced, by controlled flow, through the drilling choke C to the mud pit 8.

Referring now to FIGS. 2 and 3, a preferred embodiment of the drilling choke C of the present invention will be described. The drilling choke C comprises a body 10, seat assembly 20, operator assembly 30, stem assembly 80 and position indicator 100.

The body 10 may be cast and machined to provide an inlet 11, outlet 12 and an intermediate cavity 13 providing fluid communication between the inlet and outlet 11 and 12, respectively. Surrounding the inlet 11 is a ring joint sealing surface 14 and a plurality of threaded studs 15 for receiving nuts such as 16. These studs 15 are for engagement with a corresponding flange (not shown) for pipe fittings by which the inlet 12 may be connected to the annulus or casing of the well. In other words, this is the high pressure side of the choke.

The body outlet 12 is also surrounded by a ring joint sealing surface 17 and studs 18 by which the body may be connected to discharge piping (not shown) usually connected to the mud pit or the like. Of course, the body 10 could be provided with other types of pipe connections. The primary thing to remember is that the inlet 11 is for connection to the well and the outlet 12 for connection to the mud pit.

The seat assembly 20 is coaxially disposed in the body outlet 12 and may comprise a seat member 21, seal member 22, seat insert 23, liner 24 and stop ring 25. The seat member 21 and body outlet 12 are mutually threaded at 26, allowing the seat assembly 20 to be installed and removed from the cavity 13 by engagement of wrench notches 27, assuming the operator and stem assemblies 30 and 80 have been removed from the body 10. Sealing between the seat member 21 and the outlet 12 is provided by the O-ring seal 22. Because of the high pressures, velocities and abrasiveness of the fluids passing therethrough, the interior of the seat assembly 20 is best made of a hard material. For this reason and to reduce the cost of manufacturing the entire seat assembly 20 out of such material, the seat insert 23 and liner 24 may be made of such material, e.g. tungsten carbide. The insert 23 and liner 24 are preferably placed in the seat member 21 with an adhesive of some type. In addition, the snap-type stop ring 25 would be inserted into the groove provided on the interior of the seat member 21 for assuring that the liner, in particular, is not carried downstream. The seat insert is machined and ground with annular seating and grinding surfaces 29 and 28 for cooperation with seating surfaces on the stem assembly 80 to be more fully described hereafter.

The operator assembly 30 includes a first or lower cylindrical portion 31 and a second and larger cylindrical portion 32. The terms "lower" and "upper" as used herein and with reference to FIG. 2 of the attached drawings, refer to the left (lower) and right (upper). Such terms are merely used for relative positioning and are intended to apply regardless of the orientation of the choke C relative to the horizontal.

The lower cylindrical portion 31 is externally threaded for mutual threaded engagement 33 with a partially internally threaded corresponding hole in the body 10. Thus, the operator assembly 30 is removably attached to the body 10 in coaxial alignment with outlet 12 and the seat assembly 20. The interior of the cylindrical portion 31 is a throughbore 35 which is counterbored at 36 and 37. Partially received in the counterbore 37 is a tubular or annular bearing member 40 on the interior of which is provided a split gland seal 41 and on the exterior of which is provided a similar split gland seal 42 The bearing 40 is axially attached to the operator assembly 30 by set screws 43 which engage an annular groove 44 provided therein. Thus, the bearing 40, upon the removal of the operator assembly 30, can be removed for replacement or repair. Since it is in this area that some of the wear occurs, it is not necessary to replace much more expensive portions of the operator assembly 30, as in chokes of the prior art.

It will be noted that corresponding annular shoulders 45 and 46 on the body 10 and the bearing member 40, respectively, determine the final disposition, upon engagement, of the operator assembly 30 with the body 10. The axial distance X between the end of the bearing member 40 and the seal 41 is important. It is greater than the axial movement of the stem assembly 80. Thus, no portion of the stem assembly 80 which is subjected to the abrasive flow within cavity 13 will ever contact the seal 41.

The second or upper cylindrical portion 32 of the operator assembly 30 is closed by a threaded plug or head 50 creating a cylindrical chamber 51 in which is coaxially disposed a piston member 52 for sliding therein. An O-ring type seal assembly 53 seals the chamber 51 at one end thereof, and another O-ring type seal assembly 54 provides sliding and sealing engagement between the exterior of the piston member 52 and the interior of the chamber 51. A pressure port 55 is provided through the head 50 for communicating with the chamber 51 on one side of the piston member 52 and another pressure port 56 is provided for communicating with the chamber 51 on the opposite side of the piston 54. Connected to ports 55 and 56 respectively, are quick type connectors 57 and 58 by which hydraulic or pneumatic lines (not shown) may be attached for connecting the chamber 51 to a hydraulic pump or compressor for activating the operator assembly 30. Of course, as pressurized fluid is introduced into the chamber 51 through port 55, the piston 52 will be forced to the left as shown in FIG. 2 and if pressurized fluid is introduced through port 56, the piston member 52 will be forced to the right (as viewed in FIG. 2). The head side of the piston 52 is provided with a depressed area 60 to prevent the piston member 52 from sealing off the port 55 when bottoming out on the upstroke. Chamber 51 is counterbored at 59 to facilitate honing of the chamber. It will be noted that the throughbore 35 of the lower cylindrical portion 31 communicates with the chamber 51.

Partially disposed within the operator assembly 30 for reciprocation thereby is the stem assembly 80. The stem assembly 80 includes a upper stem member 81, a lower stem member 82 and a stem tip 83. The upper stem member 81 and thus the entire stem assembly 80 is connected to the piston member 52, as will be more fully described hereafter. By this means, the stem assembly 80 is axially movable between a first terminal position, in which the tip member 83 engages the seat assembly 20 preventing fluid communication between the inlet 11 and outlet 12; a second terminal position, allowing substantially unobstructed communication between inlets and outlets 11 and 12; and intermediate positions controlling the flow of fluids between inlet 11 and outlet 12.

The stem tip 83 is preferably of an extremely hard material, i.e. tungsten carbide, and may be removably attached to the lower stem 82 by a nut 84 and washer 86 which engages a threaded extension 85 of the lower member 82. This connection may be sealed by annular seal 87. Thus, the stem tip 83 may be easily removed from the stem assembly for repair or replacement without having to repair or replace other components of the stem assembly. Likewise, the lower stem member 82 and upper stem member 81 are provided with cooperating threads 88 allowing removal of the lower stem member 82 from the upper stem member 81. This connection may be maintained by a set screw 89 carried by the upper stem member 81.

As previously indicated, the upper stem member 81 projects through the cylindrical throughbore 35 into the chamber 51. Sealing is provided around the upper stem 81 by an annular seal assembly 90.

The upper end of the upper stem 81 is provided with a cylindrical head 91 and adjacent thereto, an annular groove 92, for connection therewith, and as best seen in FIG. 3, the lower end of the piston member 52 is provided with an elongated recess 93, one end of which is offset from the axis of the piston member and opened by hole 94 large enough to axially receive the head portion 92 of the upper stem member 81. The other end of the recess 93 is provided with a rib 95 so that the portion of the cavity 93 therebelow is U-shaped for transversely receiving the stem head 91 for coaxial alignment with the piston member. In this position, the rib 95 engages the annular groove 92 of the upper stem member to prevent axial displacement of the stem assembly 80 when so coaxially aligned with the piston member. Of course, to make this connection, either the piston member 52 or the upper stem member 81 may be free from confinement by the surrounding cylindrical portions 31 and 32, respectively. Thus, the upper stem member 81 and piston member 52 would probably be connected prior to installation in the operator assembly 30.

Mounted on the side of the operator assembly 30 is the position indicator assembly 100 for indicating the relative position of the stem assembly 80. The position indicator assembly 100 includes a position transmitter 101 which is a commercially available piece of equipment and the details and inner workings of which will not be described herein. For purposes of the present invention, it is necessary only to understand that the position of the stem assembly 80 is linearly translated to the position transmitter, causing the components thereof to be positioned in such a way that a corresponding pressure will be transmitted to a gauge (not shown) usually in the drilling rig operating panel, the pressure indicating the linear position of the stem assembly 80. To obtain the linear movement and position of the stem assembly 80, the position transmitter 101 is connected to the stem assembly 80 by a take-off arm 102, the other end of which is connected to a collar 103, the collar 103 being connected to a take-off pin 104 threadedly connected to the upper stem member 81 for radial projection therefrom. The collar is provided with a set screw 105 which, when loosened, allows adjustment of the collar on the take-off pin 104. To allow engagement with the upper stem member 81, an elongated aperture or slot 106 is provided in the cylindrical portion 31. Therefore, upon reciprocation of the stem assembly 80, the take-off pin 104 reciprocates within the elongated aperture 106 causing the take-off arm 102 to transmit the linear position of the stem assembly 80 to the position transmitter 100.

To prevent damage to the choke and particularly the operator assembly 30 and position indicator 100, a protective bonnet 110 may be placed therearound. The bonnet may be made of a tubular section 111 and a circular transverse piece 112. It could be attached in any suitable fashion.

In addition to providing means for transmitting the position of the operating assembly to the position transmitter 100, the take-off arm 102 may be provided with an extension 108 for visual indication of the position of the stem assembly 80. A worker working on the choke C can visually tell where the stem assembly 80 is located by referring to the take-off extension 108 and its relative position within the aperture 109 without having to view the gauge connected to the position transmitter 101 which may be installed a substantial distance therefrom. This warns the worker against disassembling the choke C closed under pressure, preventing subjection to dangerous situations. Alternatively, another pressure gauge (not shown) may be provided near the bonnet 110.

Thus, the drilling choke of the present invention provides an effective and efficiently operating means of maintaining control over drilling fluids. Its maintenance, particularly under field conditions, is superior to chokes of the prior art. By simply removing the operator assembly 30, the seat assembly 20 may be removed for repair or replacement. The bearing assembly 40 may be removed for repair or replacement, and the stem tip 83, or the stem tip 83 and the lower stem member 82, may also be easily removed for repair or replacement. To remove the lower stem member 82, it is necessary only to loosen the set screw 89 and threadedly disengage the lower stem member 82 from the upper stem member 81. In this operation, the take-off pin 104 bearing against the side surfaces of the aperture 106 acts as a backup to prevent rotation of the upper stem 81. All of these components may be easily removed without disturbing the hydraulics or pneumatics by which the piston member 52 and position indicator 100 are operated. This unique arrangement, particularly the arrangement of the position indicator 100, allows shortening of the operator assembly 30 and eliminates the need for a double piston rod construction as in choke apparatus of the prior art.

While a single embodiment of the invention has been described herein, many variations can be made without departing from the spirit of the invention. Accordingly, it is intended that the scope of the invention be limited only by the claims which follow.

I claim:

1. A drilling choke for controlling flow of fluids from a well, said choke comprising:

body means having an inlet, an outlet and an intermediate cavity providing fluid communication betwen said inlet and outlet;

seat means coaxially disposed in said body outlet;

operator means removably attached to said body means; and stem means, including an upper stem member, a lower stem member and a tip member; connected to said operator means and axially movable thereby between: a first terminal position, in which said tip member engages said seat member preventing fluid communication between said inlet and outlet; a second terminal position, allowing substantially unobstructed fluid communication between said inlet and outlet; and intermediate positions controlling the flow of fluids between said inlet and outlet; said lower stem member and tip member being removable from said upper stem member, upon removal of said operator means from said body means without otherwise disturbing said operator means.

2. A drilling choke as set forth in claim 1 including position indicator means attached to said operator means and operable in response to movement of said stem means for indicating the position of said stem means.

3. A drilling choke as set forth in claim 2 in which said indicator means includes an operating arm connected to said upper stem member by an operating pin through which said stem movement is transmitted for operation of said position indicator means.

4. A drilling choke as set forth in claim 3 in which said operator means comprises a first cylindrical portion having a throughbore in which said stem means is disposed for said axial movement, said first cylindrical portion being provided with an elongated aperture through which said operating pin radially projects from said upper stem for connection to said operating arm, the longitudinal position of said pin in said aperture also indicating the position of said stem means.

5. A drilling choke as set forth in claim 4 in which said lower stem member is threadedly connected to said upper stem member, allowing removal of said lower stem member and said tip member without disturbing said upper stem member or said operator means.

6. A drilling choke as set forth in claim 5 including lock screw means carried by said upper stem member engageable with said lower stem member for locking said upper and lower stem members together, said lock screw means being manipulatable through said elongated aperture for disengagement with said lower stem member allowing said removal thereof.

7. A drilling choke as set forth in claim 4 including an annular bearing member disposed near the end of said first cylindrical portion of said operator means, the interior of which slidingly and sealingly engages said lower stem member for said axial movement thereof and the exterior of which sealingly engages said body means, isolating said operator means from said well fluids, said bearing member being removable for replacement thereof upon said removal of said operator means.

8. A drilling choke as set forth in claim 7 including an annular seal member carried by said bearing member for sealingly and slidingly engaging said lower stem member during said axial movement thereof, said seal member being axially spaced with respect to the end of said bearing member nearest said cavity a distance greater than the axial movement of said stem means between said first and second terminal positions.

9. A drilling choke as set forth in claim 4 in which said operator means comprises a second cylindrical portion closed at one end thereof and in the interior of which a piston member is coaxially disposed, said throughbore of said first cylindrical portion communicating with said chamber allowing projection of said upper stem member into said second cylindrical portion for attachment to said piston member.

10. A drilling choke as set forth in claim 9 including a first annular seal member sealingly and slidingly engaging said upper stem member sealingly isolating said throughbore from said interior of said second cylindrical portion and a second annular seal member carried by said piston member for sliding and sealing engagement with the interior of said second cylindrical portion; a variable annular chamber being defined by said upper stem member, the lower end of said piston member to which said upper stem member is attached and the adjacent surfaces of said interior of said second cylindrical portion; a variable cylindrical chamber being defined by the upper end of said piston member, the closed end of said second cylindrical portion and the adjacent surfaces of said interior of said second cylindrical portion.

11. A drilling choke as set forth in claim 10 in which said variable annular chamber and said variable cylindrical chamber are connectable to sources of fluid pressure by which said stem means is axially movable between said first and second terminal positions in response to axial movement of said piston member.

12. A drilling choke as set forth in claim 9 in which the end of said upper stem member projecting into the interior of said second cylindrical portion is provided with a cylindrical head and adjacent thereto an annular groove, said lower end of said piston member provided with an elongated recess one end of which is offset from the axis of said piston member and opened to axially receive said cylindrical head of said stem, the other end of said recess being provided with a rib forming a U-shaped cavity for transversely receiving said stem head for coaxial alignment with said piston member, said rib engaging said annular groove of said upper stem member to prevent axial displacement of said stem means when so coaxially aligned with said piston member.

13. A drilling choke as set forth in claim 1 in which said tip member is removable from said lower stem member for replacement thereof without replacing other portions of said stem means.

14. A drilling choke as set forth in claim 1 including an annular bearing member surrounding said stem means and through which said stem means slidingly and sealingly reciprocates between said first and second terminal positions, said bearing member being removable, upon said removal of said operator means from said body means, for replacement or repair thereof.

15. A drilling choke as set forth in claim 14 including a resilient annular seal member carried by said bearing member for sealing engagement with said stem means, said seal member being disposed within the interior of said seal member at an axial distance from one end of said bearing member greater than the amount of axial movement between said first and second terminal positions of said stem means.

16. A drilling choke as set forth in claim 1 in which said operator means comprises a cylinder in which is disposed a reciprocating piston member, one end of said cylinder having a central passage therein through which said stem means projects for connection to said piston member; a variable annular chamber being at least partially defined by said one end of said cylinder, said stem means and the end of said piston member to which said stem means is attached; a variable cylindrical chamber being defined by the other end of said piston member, the other end of said cylinder and the adjacent cylindrical surface of said cylinder.

17. A drilling choke as set forth in claim 16 including indicator means attached to said stem means and operable in response to movement of said stem means for indicating the axial position thereof.

18. A drilling choke as set forth in claim 17 in which said indicator means is attached to said stem means through an aperture in said operator means.

19. A drilling choke as set forth in claim 16 in which said operator means includes a tubular portion adjacent said cyliner, one end of said tubular portion and said body means being provided with mutually cooperable connection means by which said operator means is removably attached to said body means, said lower stem and said stem tip being removable from said operator means, when said operator means is removed from said body means, without disturbing said cylinder or said piston member.

20. A drilling choke as set forth in claim 1 including indicator means attached to said operator means and said upper stem member, operable in response to movement of said stem means for indicating the axial position thereof, said indicator means being undisturbed by removal of said operator means from said body means and removal of said lower stem member and stem tip from said operator means.

* * * * *